United States Patent [19]

Perkins

[11] Patent Number: 4,981,153

[45] Date of Patent: Jan. 1, 1991

[54] METHOD AND APPARATUS FOR REDUCING HYDROCARBON VAPOR EMISSION FROM A STORAGE TANK

[75] Inventor: Thomas K. Perkins, Dallas, Tex.

[73] Assignee: Atlantic Richfield Company, Los Angeles, Calif.

[21] Appl. No.: 526,253

[22] Filed: May 21, 1990

[51] Int. Cl.[5] ..... B65B 3/04

[52] U.S. Cl. ..... 137/1; 137/575; 137/265; 141/35; 141/1; 220/85 VR

[58] Field of Search ..... 137/575, 1, 2, 255, 137/256, 265; 220/85 VR, 85 VS, 88.3; 141/2, 35, 36, 52

[56] References Cited

U.S. PATENT DOCUMENTS

| | | | |
|---|---|---|---|
| 4,157,248 | 6/1979 | Queiser | 220/85 VR |
| 4,266,580 | 5/1981 | Dixon | 137/575 X |
| 4,304,271 | 12/1981 | Larssen | 141/35 |
| 4,515,189 | 5/1985 | Larssen | 137/575 X |
| 4,586,547 | 5/1986 | Fields | 137/575 X |

*Primary Examiner*—Alan Cohan

*Attorney, Agent, or Firm*—Roderick W. MacDonald

[57] ABSTRACT

A method and apparatus for reducing hydrocarbon vapor emission from a hydrocarbonaceous liquid in a storage tank during filling of same wherein at least two storage tanks are present and an essentially inert gas is provided in a first storage tank containing said hydrocarbonaceous liquid, the inert gas being at a temperature at least about equal to or above the temperature of the hydrocarbonaceous liquid, and as said first storage tank fills with hydrocarbonaceous liquid removing at least a portion of said inert gas from said first storage tank and passing same into a least one second storage tank that is later to be filled thereby (a) displacing from said second storage tank atmospheric gas originally present which is below the temperature of said hydrocarbonaceous liquid, (b) prewarming said second storage tank, (c) substituting said inert gas for said atmospheric gas, and (d) reducing hydrocarbon vapor emission from the fill liquid in the second storage tank.

8 Claims, 1 Drawing Sheet

METHOD AND APPARATUS FOR REDUCING HYDROCARBON VAPOR EMISSION FROM A STORAGE TANK

BACKGROUND OF THE INVENTION

Heretofore when filling a storage tank on a maritime tanker, in an on-shore tank battery, or the like, hydrocarbon vapor may be generated due to the temperature difference between (1) the hydrocarbonaceous liquid which is entering and filling the storage tank and (2) the gas, hereinafter referred to as "atmospheric gas", occupying the empty storage tank before filling of same. In many locations of the world the temperature of the hydrocarbonaceous liquid being loaded into the storage tank greatly exceeds the temperature of the atmospheric gas at the time of filling. Hydrocarbon vapor can be generated because such vapor as emitted from the hydrocarbonaceous liquid near the liquid-gas interface is heated and, therefore, less dense than the overlying atmospheric gas. This causes vapor-gas interchange that lifts the evaporated hydrocarbon vapor higher into the overlying gas space and returns atmospheric gas to the vicinity of the liquid-gas interface. This mechanism tends to reduce the partial pressure of hydrocarbon vapor in the gas near the oil-gas interface and thereby accelerates the rate of hydrocarbon vapor diffusion into the overlying gas. Accordingly, additional evaporation of hydrocarbons is accelerated.

Heretofore, it has been proposed that, when filling a storage tank with the hydrocarbonaceous liquid having a temperature greater than the ambient temperature within the storage tank, the amount of hydrocarbon vapor emission can be reduced by providing in the storage tank to be filled an essentially inert gas which is at a temperature which matches or exceeds the temperature of the hydrocarbonaceous liquid introduced into the storage tank during the filling process. This is fully and completely disclosed in co-pending U.S. Pat. Application, Ser. No. 07/497278, filed Mar. 22, 1990, and having a common inventor and assignee.

It has since been found, in accordance with this invention, that the method for reducing hydrocarbon vapor emission from a storage tank during the filling of same can be even further improved (reduced) when employing an essentially inert gas at a temperature which matches or exceeds the temperature of the hydrocarbonaceous liquid entering the storage tank during the filling process. The improvement is obtained by employing more than one storage tank and removing at least a portion of said temperature controlled inert gas from a first storage tank which is being filled and passing such removed inert gas into at least one second storage tank that is later to be filled with similar liquid.

SUMMARY OF THE INVENTION

According to this invention there is provided a method and apparatus for reducing hydrocarbon vapor emission from a storage tank during filling of same at a fill site where at least two storage tanks are present. This is accomplished by providing essentially inert gas in at least one first storage tank containing a hydrocarbonaceous fill liquid, such inert gas being placed above the liquid-gas interface in such tank, the inert gas being at a temperature at least about equal to or above the temperature of the hydrocarbonaceous fill liquid. Thereafter, as the first storage tank fills with hydrocarbonaceous liquid, at least a portion of the inert gas in said first tank is removed therefrom and passed into at least one second storage tank that is later to be filled with hydrocarbonaceous liquid. This process (1) displaces from the second storage tank atmospheric gas therein which is undesirable, for example, below the temperature of the hydrocarbonaceous fill liquid, (2) prewarms the second storage tank while substituting essentially inert gas for atmospheric gas already therein, and (3) reduces the hydrocarbon vapor emission from the hydrocarbonaceous liquid when it is finally introduced into the thus prepared interior of the second storage tank.

Accordingly, it is an object of this invention to provide a new and improved method and apparatus for reducing hydrocarbon vapor emission from a plurality of storage tanks. It is another object to provide a new and improved method and apparatus for reducing hydrocarbon vapor emission from a water borne tanker which contains a plurality of storage tanks while the tanker is being loaded with crude oil or other hydrocarbonaceous liquid. It is another object to provide a new and improved method for reducing hydrocarbon vapor emission from a land based tank battery which has a plurality of storage tanks available, while one, two or more of those tanks are being filled with crude oil or other hydrocarbonaceous liquid. Other aspects, objects and advantages of this invention will be apparent to those skilled in the art from this disclosure and the appended claims.

DETAILED DESCRIPTION

Figure 1:
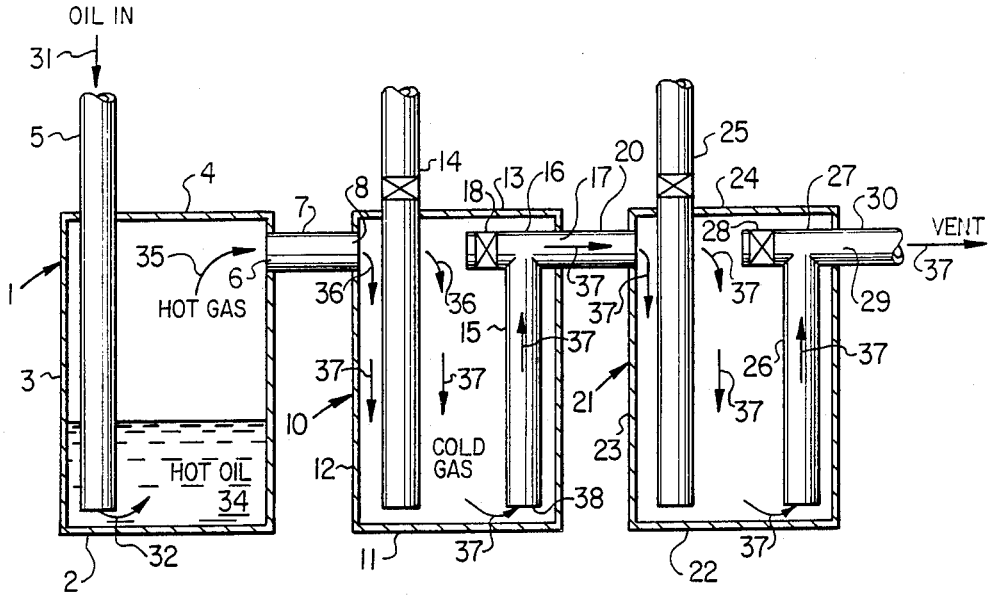
FIG. 1 shows a vertical cross section of three separate storage tanks connected to one another for the practice of the method of this invention.

FIG. 1 shows three independent storage tanks hooked in series to one another. These tanks can be in place on a crude oil tanker or other floating vessel, on shore in an oil field or refinery, or the like.

First storage tank 1 is comprised of a bottom 2 closed by upstanding walls 3 and top 4. Conduit means 5 is employed to pass a fill liquid such as crude oil or refined hydrocarbons (gasoline, kerosene, diesel oil, etc.) therethrough into tank 1 at or near bottom 2 thereof. This way, tank 1 is filled with liquid from the bottom toward top 4. At or near top 4 side 3 has an aperture 6 therein which is fixed in a gas and liquid tight manner to conduit means 7. Conduit 7 is connected in like manner to a matching aperture 8 in second storage tank 10.

Tank 10 has, like tank 1, a closed bottom 11 upstanding sides 12 and top 13, together with a fill conduit 14 for admitting liquid to be stored in tank 10 at or near bottom 11. Second tank 10 carries in its interior upstanding vapor conduit means 15 which is connected to a second, for example essentially horizontal, conduit means 16 at or near top 13. Conduit 15 T's into conduit 16 so that one end of conduit 16 can connect to aperture 17 in upstanding wall 12 in a gas and liquid tight manner. The opposing end of conduit 16 extends into the interior of tank 10 a finite distance beyond conduit 15 so that such opposing end can carry a gas bypass valve means 18. This way, interconnecting conduit 20 between second tank 10 and third tank 21 can conduct gas out from the interior of tank 10 either from near the bottom 11 of such tank by way of conduit 15 or in the vicinity of top 13 by way of valve 18 and conduit 16, or both. This interrelation will be described in greater detail hereinafter.

Similarly, third storage tank 21, having bottom 22, upstanding sides 23, and top 24, together with fill conduit 25 for the admission of liquid into the interior thereof for storage, has an upstanding conduit means 26 T'd into nonvertical conduit means 27. Conduit 27 carries at one end a gas bypass valve means 28 and is connected at the other end through aperture 29 in wall 23 to conduit means 30. Conduit 30 can itself be connected to yet another storage tank or employed as a vent means or the like.

In the practice of this invention, as an example, hot crude oil at about 110° F. and about 1 psig is loaded into the interior of steel tank 1 by way of conduit 5 as shown by arrow 31. Hot oil enters the interior of tank 1 at or near bottom 2 as shown by arrow 32. The crude oil-inert gas interface 33 continually rises toward top 4 as more hot oil is admitted through conduit 5. As liquid-gas interface 33 rises, hot inert gas that was initially present in the interior of tank 1 at a temperature at least about equal to or above the temperature of hot oil 34, e.g., 110° F. and 1 psig, is removed from first tank 1 by way of conduit 7 as indicated by arrows 35 and 36 for admission into the interior of second tank 10. With bypass valve 18 closed, the admission of hot inert gas 36 to the interior of empty tank 10 forces atmospheric gas, originally present in empty tank 10 down toward empty bottom 11 and thereby into conduit 15 as indicated by arrows 37. This way cold atmospheric gas is forced from the interior of empty tank 10 in such a way that hot inert gas 36 passes through the entire depth of that tank thereby not only displacing cold atmospheric gas from the interior thereof but also prewarming tank 10 for the later time when hot crude oil will be admitted to the interior of tank 10 by way of conduit 14.

Thus, hot inert gas at a temperature of about 110° F. and 1 psig is removed from tank 1 pursuant to its natural volumetric displacement from tank 1 by normal fillings of tank 1 with crude oil and used as a displacement medium for cold atmospheric gas already in tank 10 at a temperature of 60° F. and 1 psig and to warm tank 10 to a temperature of at least about 110° F. before the admission of crude oil at 110° F. by way of conduit 14.

When the liquid level of oil in tank 10 is above lower end 38 of conduit 15, bypass valve 18 is opened to allow further venting of gas from the interior of tank 10 directly through valve 18 into conduits 16 and 20 and, therefore, into the interior of tank 21. This way, as hot oil fills the interior of tank 10 in the same manner described for tank 1, hot inert gas can be removed from tank 10 for entry into tank 21 to force cold atmospheric gas out of its interior through conduit 26 as also just described for tank 10 and its conduit 15. This prewarms tank 21 for subsequent addition of hot oil to the interior thereof by way of conduit 25. Gas bypass valve 28 in tank 21 is operated in the same manner as just described for valve 18 of tank 10.

By the foregoing process hot inert gas is employed in a plurality of tanks, in a series manner, to prewarm the tank and to provide an interior gaseous atmosphere at least about equal to or above the temperature of the liquid to be stored in the tanks thereby reducing hydrocarbon vapor emission from such liquid when it first enters into and as it fills the storage tank.

Figure 2:
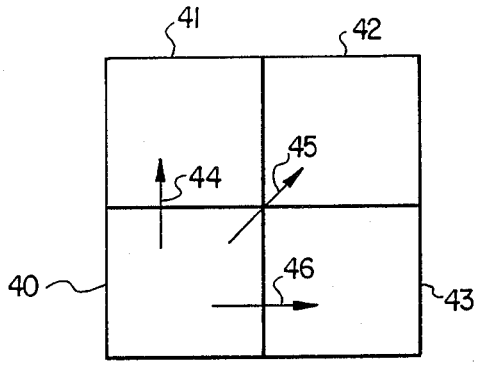
FIG. 2 shows a top view of yet another arrangement of storage tanks useful for the practice of this invention.

FIG. 2 shows a top view of four storage tanks 40, 41, 42, and 43 wherein first storage tank 40 corresponds to tank 1 of FIG. 1. Tank 40 is the first tank filled with essentially inert hot gas before hot oil is introduced into the interior thereof as described hereinabove with respect to tank 1. As the liquid-gas interface in tank 40 (similar to interface 33 in tank 1) rises toward the top of tank 40, hot inert gas is removed from tank 40 into the interior of at least two of tanks 41, 42, and 43 as indicated by arrows 44, 45, and 46. This removal process can be conducted as regards tanks 41–43, at the same time or sequentially in any desired manner. Thus, FIG. 2 shows that this invention can be practiced not only serially as shown in FIG. 1 but in parallel as shown in FIG. 2. Of course, more than one tank can be filled at the same time and inert gas displaced from more than one tank being filled into only one (or more than one) tank later to be filled.

The pressures in the various tank means can vary widely but will generally vary from about atmospheric pressure to about 2 psig depending upon the fill rate, nature of the valves and piping employed and/or the nature of the essentially inert hot gas employed. The inert gas can come from any desirable and conveniently available source such as from treated flue gas available from a convenient power source, for example, the propulsion system of an ocean going tanker, a steam generator in an oil field or refinery, or the like. Any gas which is essentially inert to the atmospheric gas originally in the tank and the hot liquid to be introduced into and stored in the tank can be employed, for example, carbon dioxide, nitrogen, or more exotic gases such as helium, argon, or the like.

Reasonable variations and modifications are possible within the scope of this disclosure without departing from the spirit and scope of this invention.

What is claimed is:

1. A method for reducing hydrocarbon vapor emission from a storage tank during filling of same at a fill site having at least two storage tanks, the improvement comprising providing essentially inert gas in at least one first storage tank which is being filled with a hydrocarbonaceous liquid, said inert gas establishing a hydrocarbonaceous liquid-inert gas interface and being at a temperature at least about equal to or above the temperature of said hydrocarbonaceous liquid, as said at least one first storage tank fills with said hydrocarbonaceous liquid removing at least a portion of said inert gas from said at least one first storage tank and passing same into at least one second storage tank that is later to be filled with hydrocarbonaceous liquid thereby to (a) displace from said at least one second storage tank atmospheric gas therein which is below said hydrocarbonaceous liquid temperature (b) prewarm said at least one second storage tank (c) substitute essentially inert gas for said atmospheric gas and (d) reduce hydrocarbon vapor emission from said hydrocarbonaceous liquid in said at least one second storage tank.

2. The process according to claim 1 wherein a plurality of second storage tanks is employed.

3. The process according to claim 2 wherein said second storage tanks are employed in series with one another.

4. The process according to claim 2 wherein said second storage tanks are employed in parallel with one another.

5. The process according to claim 1 wherein said inert gas is allowed to pass into said at least one second storage tank pursuant to its natural volumetric displacement from said at least one first storage tank due to the normal filling of said at least one first storage tank with said hydrocarbonaceous liquid.

6. Apparatus for storing a liquid comprising at least two tank means including a first tank means having first bottom, side and top means, first conduit means for admitting liquid to the interior of said first tank means near said first bottom means, second conduit means for removing gas from the interior of said first tank means near said first top means and passing said removed gas to a second tank means, said second tank means having second bottom, side and top means, third conduit means for admitting liquid to the interior of said second tank means near said second bottom means, fourth conduit means upstanding in the interior of said second tank means, said fourth conduit means being open near said second bottom means and connected near said second top means to an outlet means near said second top means, and a gas bypass means carried by said outlet means so that gas can be admitted to said outlet means by said bypass means when said opening in said fourth conduit means near said second bottom means is covered with liquid to be stored in said second tank means.

7. The apparatus according to claim 6 wherein at least one additional tank means is in fluid communication with said first tank means.

8. The apparatus according to claim 6 wherein at least one additional tank means is in fluid communication with said second tank means.

* * * * *